US010186364B2

(12) United States Patent
Yen et al.

(10) Patent No.: US 10,186,364 B2
(45) Date of Patent: Jan. 22, 2019

(54) ELECTRONIC DEVICE WITH TWO PLANAR INDUCTORS

(71) Applicant: Realtek Semiconductor Corp., HsinChu (TW)

(72) Inventors: Hsiao-Tsung Yen, Hsinchu (TW); Kai-Yi Huang, Taipei (TW); Yuh-Sheng Jean, Hsinchu (TW); Ta-Hsun Yeh, Hsinchu (TW)

(73) Assignee: Realtek Semiconductor Corp., HsinChu (TW)

( * ) Notice: Subject to any disclaimer, the term of this patent is extended or adjusted under 35 U.S.C. 154(b) by 196 days.

(21) Appl. No.: 14/722,167

(22) Filed: May 27, 2015

(65) Prior Publication Data

US 2015/0364243 A1 Dec. 17, 2015

(30) Foreign Application Priority Data

Jun. 13, 2014 (TW) ..... 103120614 A

(51) Int. Cl.
*H01F 27/28* (2006.01)
*H01F 17/00* (2006.01)
*H01F 27/34* (2006.01)

(52) U.S. Cl.
CPC ..... *H01F 27/2804* (2013.01); *H01F 17/0033* (2013.01); *H01F 27/346* (2013.01); *H01F 2017/0073* (2013.01); *H01F 2027/2809* (2013.01)

(58) Field of Classification Search
CPC ..... H01F 5/00; H01F 27/28
USPC ..... 336/200, 232
See application file for complete search history.

(56) References Cited

U.S. PATENT DOCUMENTS

| | | | | |
|---|---|---|---|---|
| 7,796,007 | B2 * | 9/2010 | Hopper | H01F 27/2804 336/200 |
| 2004/0140878 | A1 * | 7/2004 | Heima | H01F 17/0013 336/223 |
| 2007/0216377 | A1 * | 9/2007 | Yoshimura | H04L 25/0266 323/250 |

(Continued)

FOREIGN PATENT DOCUMENTS

| | | |
|---|---|---|
| CN | 101621065 A | 1/2010 |
| CN | 102543965 A | 7/2012 |

(Continued)

*Primary Examiner* — Tsz Chan
(74) *Attorney, Agent, or Firm* — Winston Hsu

(57) ABSTRACT

An electronic device includes a first planar inductor and a second planar inductor. The first planar inductor includes at least a first ring structure and a second ring structure interconnected electrically for generating a first magnetic field having a first direction and a second magnetic field having a second direction respectively, wherein the first direction is different from the second direction. The second planar inductor includes at least a third ring structure and a fourth ring structure interconnected electrically for generating a third magnetic field having a third direction and a fourth magnetic field having a fourth direction respectively, wherein the third direction is different from the fourth direction. The first ring structure at least partially overlaps the third ring structure to form a first overlap region, and the second ring structure at least partially overlaps the fourth ring structure to form a second overlap region.

10 Claims, 10 Drawing Sheets

(56) References Cited

U.S. PATENT DOCUMENTS

| | | | | |
|---|---|---|---|---|
| 2008/0266042 | A1* | 10/2008 | Yoshimura | H01F 27/2804 336/181 |
| 2011/0050357 | A1* | 3/2011 | Kim | H01L 23/5227 333/32 |
| 2012/0147578 | A1* | 6/2012 | Jin | H01F 19/04 361/774 |
| 2012/0242406 | A1* | 9/2012 | Ke | H01F 27/2804 330/195 |

FOREIGN PATENT DOCUMENTS

| | | | | |
|---|---|---|---|---|
| JP | 08181018 | A | * | 7/1996 |
| JP | 2005327931 | A | * | 11/2005 |

* cited by examiner

ELECTRONIC DEVICE WITH TWO PLANAR INDUCTORS

BACKGROUND OF THE INVENTION

1. Field of the Invention

The disclosed embodiments of the present invention relate to an electronic device, and more particularly, to an electronic device having a first planar inductor and a second planar inductor at least partially overlapping each other.

2. Description of the Prior Art

An inductor, also called a coil or reactor, is a passive two-terminal electrical component which resists changes in electric current passing through it, and preserves energy. An inductor may be utilized to preserve energy in a DC-DC converter. The storage is proportional to inductance; therefore large inductance is always required by systems. In certain circumstances, two inductors are interconnected electrically to form a transformer.

An inductor usually occupies a relatively large area compared to other devices . Hence, there is a need for a novel inductor structure with a smaller size to reduce the area of the transformer. How to achieve this while enlarging unit inductance is a problem in this field that needs to be addressed.

SUMMARY OF THE INVENTION

One of the objectives of the present invention is to provide an electronic device having a first planar inductor and a second planar inductor at least partially overlapping each other to improve upon the aforementioned issues.

According to a first aspect of the present invention, an electronic device is disclosed. The electronic device comprises a first planar inductor and a second planar inductor. The first planar inductor comprises at least a first ring structure and a second ring structure interconnected electrically for generating a first magnetic field having a first direction and a second magnetic field having a second direction respectively, wherein the first direction is different from the second direction. The second planar inductor comprises at least a third ring structure and a fourth ring structure interconnected electrically for generating a third magnetic field having a third direction and a fourth magnetic field having a fourth direction respectively, wherein the third direction is different from the fourth direction. The first ring structure at least partially overlaps the third ring structure to form a first overlap region, and the second ring structure at least partially overlaps the fourth ring structure to form a second overlap region.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is electrically connected to another device, that connection may be through a direct electrical connection, or through an indirect electrical connection via other devices and connections.

Figure 1:
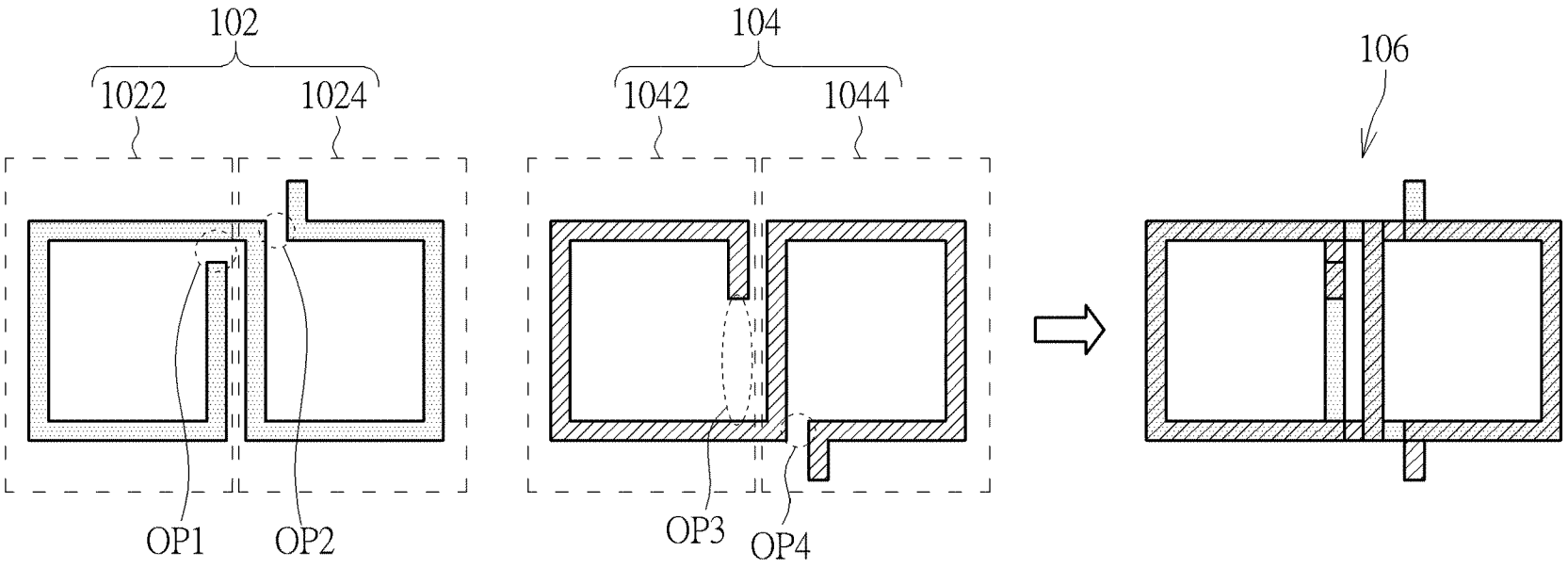
FIG. 1 is a diagram illustrating an electronic device according to a first embodiment of the present invention.

FIG. 1 is a diagram illustrating an electronic device according to a first embodiment of the present invention. The electronic device 106 includes a planar inductor 102 and a planar inductor 104, and is used as an inductor. The planar inductor 102, including a first ring structure 1022 and a second ring structure 1024, is disposed at a first conducting layer. The first ring structure 1022 generates a first magnetic field having a first direction; the second ring structure 1024 generates a second magnetic field having a second direction. In one exemplary design, the first direction is perpendicular to a plane on which the first ring structure 1022 is disposed and points upwards; the second direction is perpendicular to a plane on which the first ring structure 1024 is disposed and points downwards. The planar inductor 102 has an inductance value $H_{102}$. Further, the planar inductor 104 is disposed at a second conducting layer different from the first conducting layer. The planar inductor 104 includes a third ring structure 1042 and a fourth ring structure 1044. The third ring structure 1042 generates a third magnetic field having a third direction; the fourth ring structure 1044 generates a fourth magnetic field having a fourth direction. In one exemplary design, the third direction is perpendicular to a plane on which the third ring structure 1042 is disposed and points upwards; the fourth direction is perpendicular to a plane on which the fourth ring structure 1044 is disposed and points downwards. The first direction and the third direction are the same; and the second direction and the fourth direction are the same. An opening OP1 of the first ring structure 1022 is located at the right side; an opening OP2 of the second ring structure 1024 is located at the up side; an opening OP3 of the third ring structure 1042 is located at the right side; and an opening OP4 of the fourth ring structure 1044 is located at the down side. The planar inductor 104 has an inductance value $H_{104}$. The planar inductor 102 and the planar inductor 104 are interconnected electrically to form the electronic device 106, i.e. a stacked inductor. A terminal of the first ring structure 1022 and a terminal of third ring structure 1042 may be electrically connected by a via. A union region of the first ring structure 1022 and the second ring structure 1024 of the planar inductor 102 completely overlap a union region of the third ring structure 1042 and the fourth ring structure 1044 of the planar inductor 104. In this way, an inductance value $H_{106}$ of the electronic device 106 can be enlarged as far as possible. The inductance value $H_{106}$ is larger than the inductance value $H_{102}$ and inductance value $H_{104}$ respectively. As a result, the unit inductance is enlarged. In summary, the electric device obtained by combining two (8-shaped like) planar inductors shown in FIG. 1 possesses larger unit inductance compared to the conventional spiral inductor. Furthermore, the electromagnetic interference (EMI) may be effectively reduced due to the opposing direction of the magnetic fields of the stacked first and third ring structure 1022 and 1042 and the stacked second and fourth ring structure 1024 and 1044.

Figure 2A:
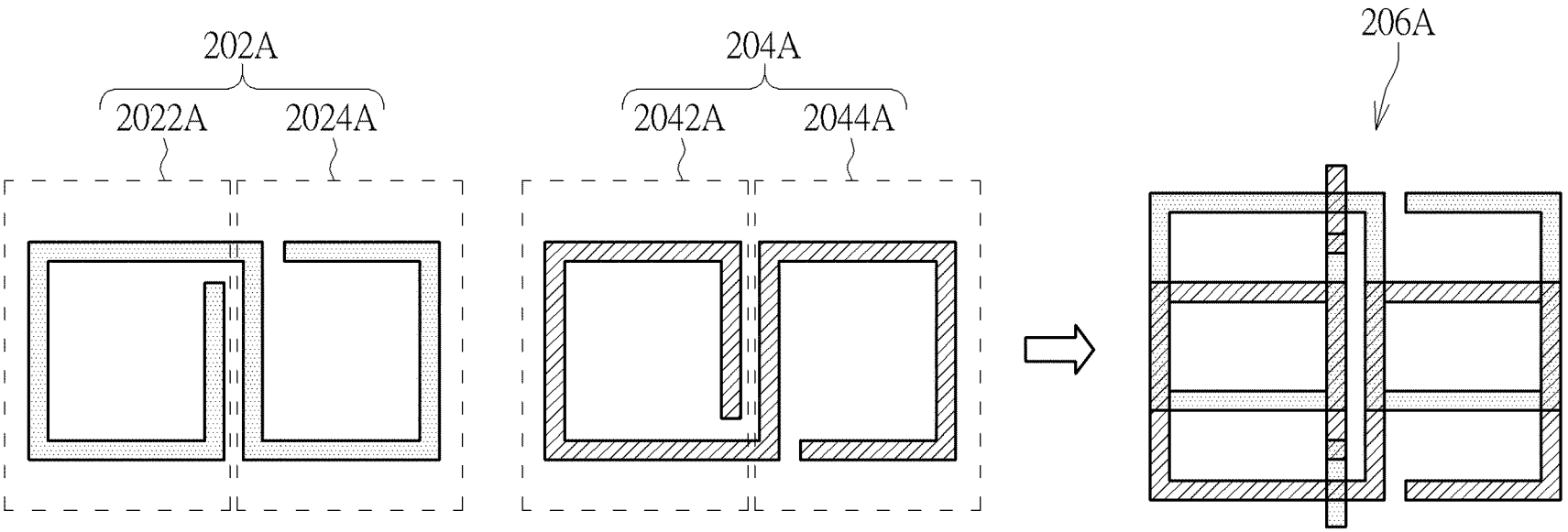
FIG. 2A is a diagram illustrating an electronic device according to a second embodiment of the present invention.

FIG. 2A is a diagram illustrating an electronic device according to a second embodiment of the present invention. The electronic device 206A includes a planar inductor 202A and a planar inductor 204A, and is used as a transformer. The planar inductor 202A, including a first ring structure 2022A and a second ring structure 2024A, is disposed at a first conducting layer. The first ring structure 2022A generates a first magnetic field having a first direction; the second ring structure 2024A generates a second magnetic field having a second direction. In one exemplary design, the first direction is perpendicular to a plane on which the first ring structure 2022A is disposed and points upwards; the second direction is perpendicular to a plane on which the first ring structure 2024A is disposed and points downwards. The planar inductor 202A has an inductance value $H_{202A}$ . Further, the planar inductor 204A is disposed at a second conducting layer different from the first conducting layer. The planar inductor 204A includes a third ring structure 2042A and a fourth ring structure 2044A. The third ring structure 2042A generates a third magnetic field having a third direction; the fourth ring structure 2044A generates a fourth magnetic field having a fourth direction. In one example design, the third direction is perpendicular to a plane on which the third ring structure 2042A is disposed and points upwards; the fourth direction is perpendicular to a plane on which the fourth ring structure 2044A is disposed and points downwards. The planar inductor 204A has an inductance value $H_{204A}$ . The planar inductor 202A and the planar inductor 204A are stacked to form the electric device 206A, i.e. a transformer, wherein the coupling factor $K_{206A}$ is relevant to the overlap region between a union region of the first ring structure 2022A and the second ring structure 2024A of the planar inductor 202A and a union region of the third ring structure 2042A and the fourth ring structure 2044A of the planar inductor 204A. The first ring structure 2022A and the second ring structure 2024A are not limited to be disposed on a single die. In an example, they may be implemented by three-dimensional stack packaging. Specifically, the first ring structure 2022A and the second ring structure 2024A may be disposed at an upper die and a bottom die, respectively, and under-fill materials may be used between the two dies as filler.

Figure 2B:
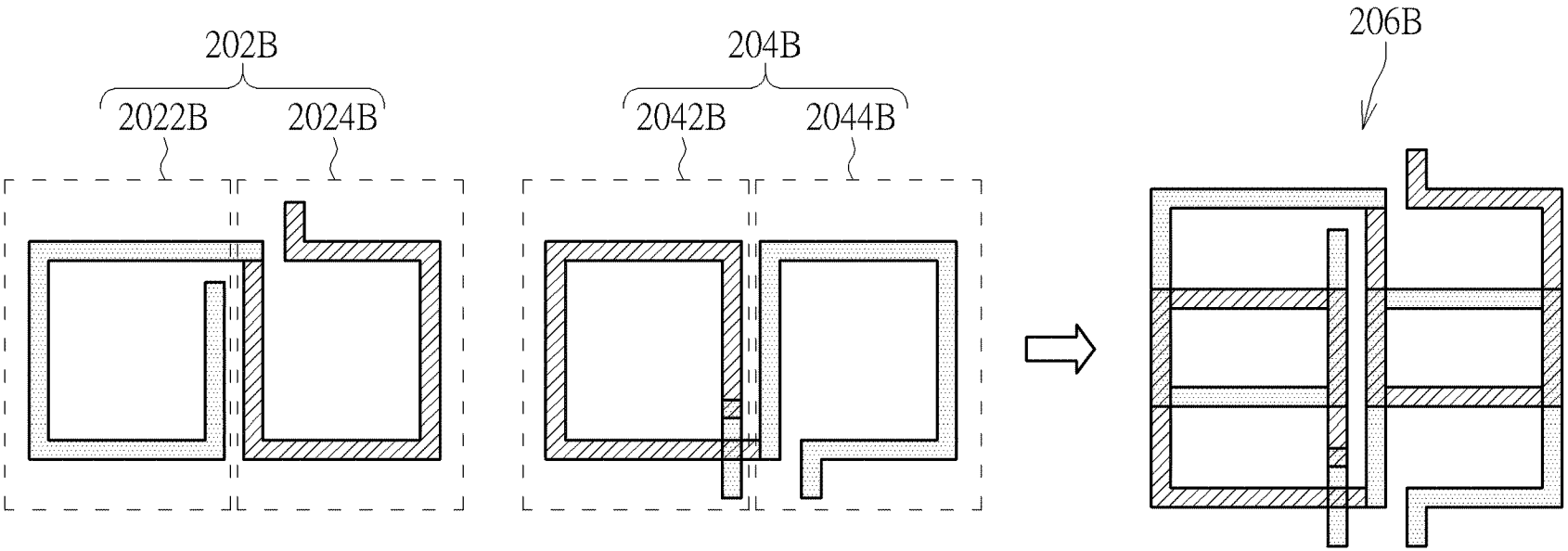
FIG. 2B is a diagram illustrating an electronic device according to a third embodiment of the present invention.

FIG. 2B is a diagram illustrating an electronic device according to a third embodiment of the present invention. The electronic device 206B includes a planar inductor 202B and a planar inductor 204B, and is used as a transformer. The planar inductor 202B, including a first ring structure 2022B and a second ring structure 2024B. The first ring structure 2022B is disposed at a first conducting layer and the second ring structure 2024B is disposed at a second conducting layer. The first ring structure 2022B generates a first magnetic field having a first direction; the second ring structure 2024B generates a second magnetic field having a second direction. In one example design, the first direction is perpendicular to a plane on which the first ring structure 2022B is disposed and points upwards; the second direction is perpendicular to a plane on which the first ring structure 2024B is disposed and points downwards. The planar inductor 202B has an inductance value $H_{202B}$. Further, the planar inductor 204B includes a third ring structure 2042B and a fourth ring structure 2044B. The third ring structure 2042B is disposed at the second conducting layer and the fourth ring structure 2044B is disposed at the first conducting layer. The third ring structure 2042B generates a third magnetic field having a third direction; the fourth ring structure 2044B generates a fourth magnetic field having a fourth direction. In one exemplary design, the third direction is perpendicular to a plane on which the third ring structure 2024B is disposed and points upwards; the fourth direction is perpendicular to a plane on which the fourth ring structure 2044B id disposed and points downwards. The planar inductor 204B has an inductance value $H_{204B}$. The planar inductor 202B and the planar inductor 204B are stacked to form the electric device 206B, i.e. a transformer, wherein the first ring structure 2022B overlaps the third ring structure 2042B; the second ring structure 2042B overlaps the fourth ring structure 2044B. According to FIG. 2B, although the planar inductor 202B and the planar inductor 204B both occupy two conducting layers, the combined electric device 206B still occupies only two conducting layers. The coupling factor $K_{206B}$ is relevant to the overlap region between a union region of the first ring structure 2022B and the second ring structure 2024B of the planar inductor 202B and a union region of the third ring structure 2042B and the fourth ring structure 2044B of the planar inductor 204B.

Figure 2C:
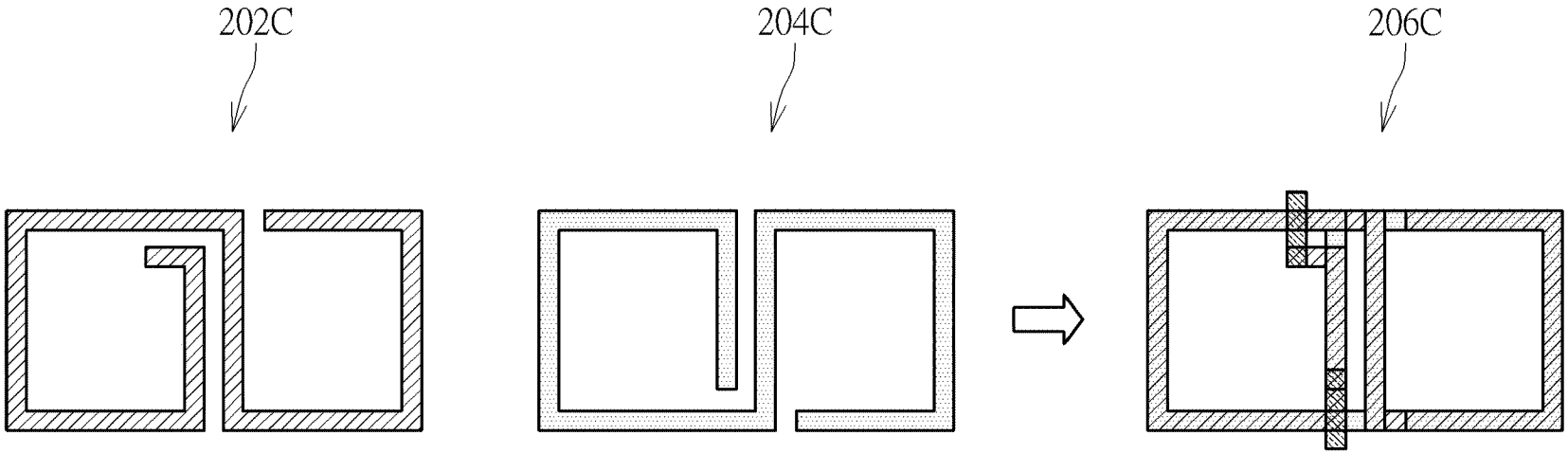
FIG. 2C is a diagram illustrating an electronic device according to a fourth embodiment of the present invention.

FIG. 2C is a diagram illustrating an electronic device according to a fourth embodiment of the present invention. The electronic device 206C includes a planar inductor 202C and a planar inductor 204C, and is used as a transformer. The electronic device 206C is similar to the electronic device 206A except that the overlap region is enlarged. A coupling factor $K_{206C}$ of the planar inductor 202C is therefore larger than the coupling factor $K_{206A}$ of the planar inductor 202A. Further, the planar inductor 202C requires one more conducting layer for wire routing compared to the planar inductor 202A.

Figure 2D:
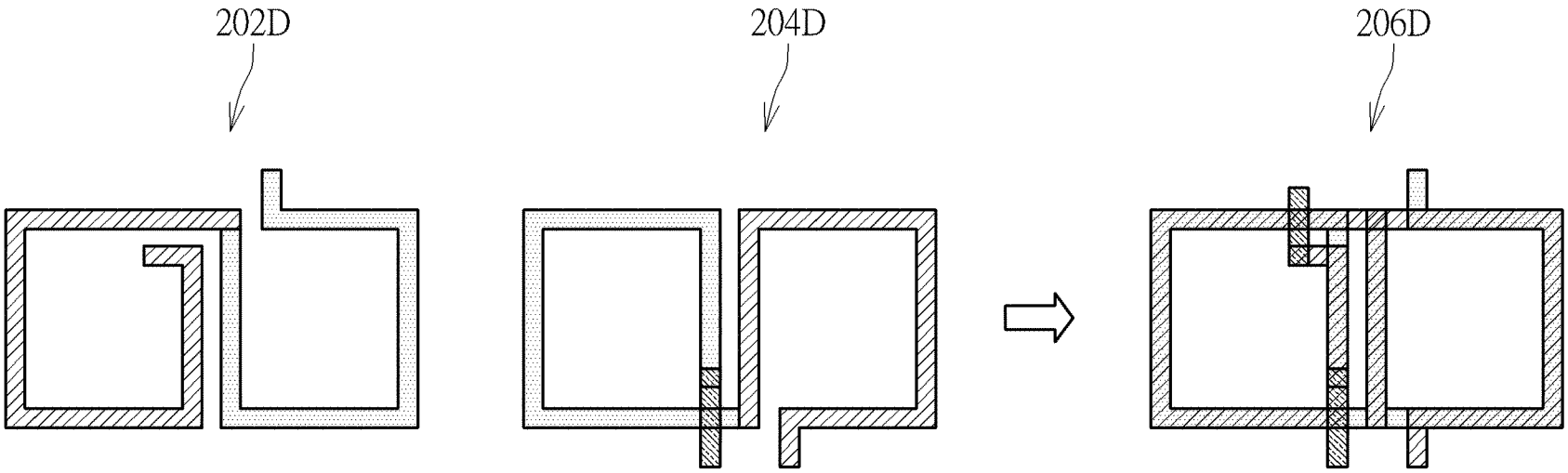
FIG. 2D is a diagram illustrating an electronic device according to a fifth embodiment of the present invention.

FIG. 2D is a diagram illustrating an electronic device according to a fifth embodiment of the present invention. The electronic device 206D includes a planar inductor 202D and a planar inductor 204D, and is used as a transformer. The electronic device 206D is similar to the electronic device 206B except that the overlap region is enlarged. A coupling factor $K_{206D}$ of the planar inductor 202D is therefore larger than the coupling factor $K_{206B}$ of the planar inductor 202B. Further, the planar inductor 202D requires one more conducting layer for wire routing compared to the planar inductor 202B.

Figure 3A:
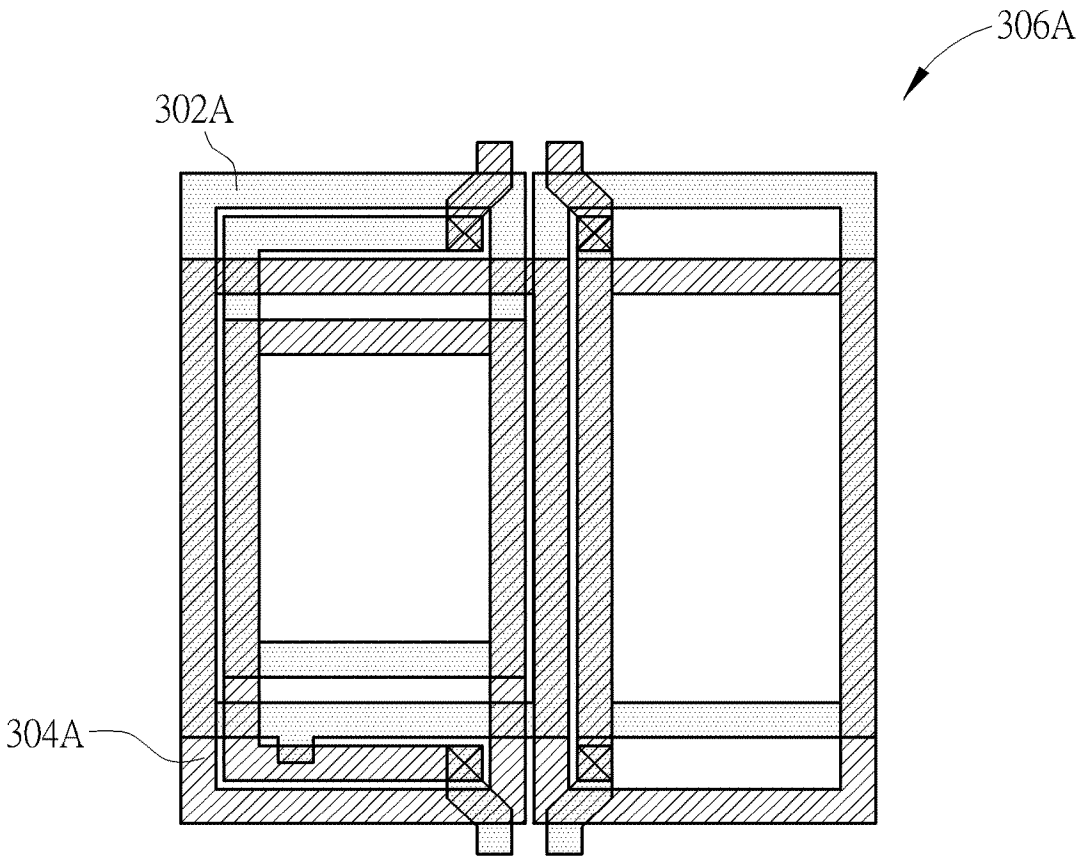
FIG. 3A is a diagram illustrating an electronic device according to a sixth embodiment of the present invention.

FIG. 3A is a diagram illustrating an electronic device according to a sixth embodiment of the present invention. The electronic device 306A includes an asymmetric planar inductor 302A and an asymmetric planar inductor 304A, and is used as a transformer. The electronic device 306A is similar to the electronic device 206A except it also includes a first ring structure (which is spiral shaped) having a number of coils different from that of a second ring structure. The first ring structure has a stronger magnetic field compared to the second ring structure, as does the planar inductor 304A. Specifically, the first ring structure (having a greater number of coils) of the planar inductor 302A of the electric device 306A overlaps the first ring structure (having a greater number of coils) of the planar inductor 304A of the electric device 306A; the second ring structure (having a fewer number of coils) of the planar inductor 302A of the electric device 306A overlaps the second ring structure (having a fewer number of coils) of the planar inductor 304A of the electric device 306A.

Figure 3B:
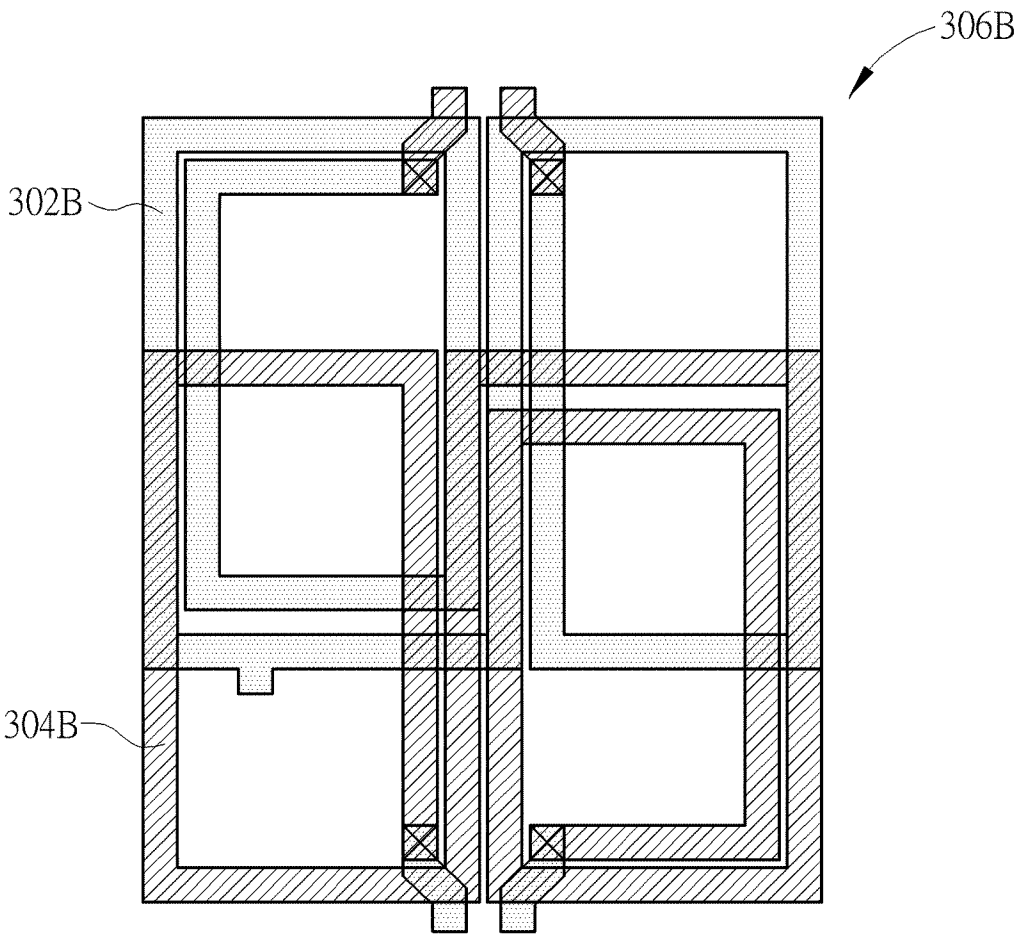
FIG. 3B is a diagram illustrating an electronic device according to a seventh embodiment of the present invention.

FIG. 3B is a diagram illustrating an electronic device according to a seventh embodiment of the present invention. The electronic device 306B includes an asymmetric planar inductor 302B and an asymmetric planar inductor 304B, and is used as a transformer. The electronic device 306B is similar to the electronic device 306A except that a first ring structure (having a greater number of coils) of the planar inductor 302B of the electric device 306B overlaps a first ring structure (having a fewer number of coils) of the planar inductor 304B of the electric device 306B; a second ring structure (having a fewer number of coils) of the planar inductor 302B of the electric device 306B overlaps a second ring structure (having a greater number of coils) of the planar inductor 304B of the electric device 306B. A coupling factor $K_{306B}$ of the electric device 306B will become smaller than that of the electric device 306A since the magnetic field neutralization effect of the electric device 306B is exacerbated by the mirrored arrangement. Those skilled in the art should readily understand the details according to the 'rule of thumb' principle.

Figure 4:
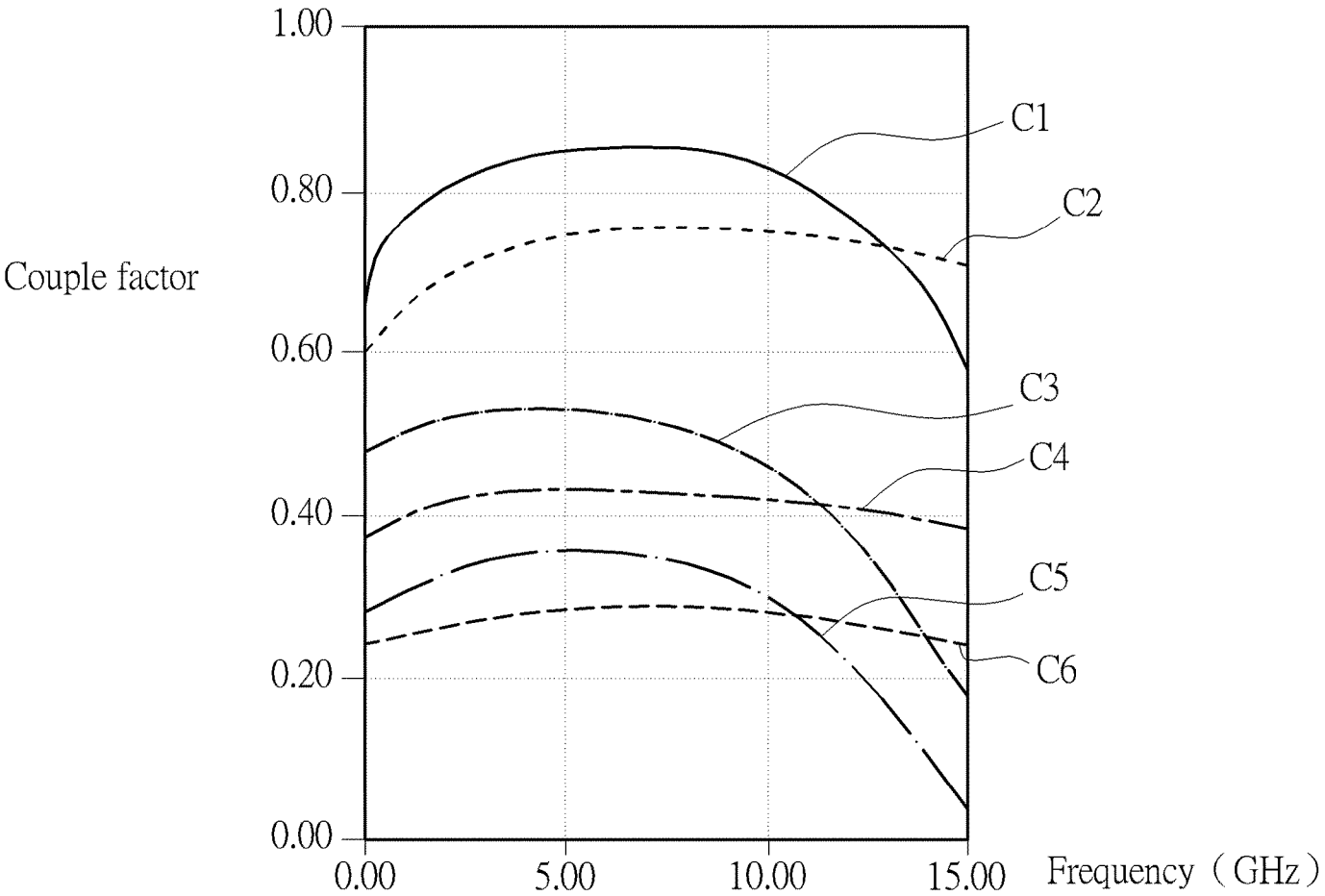
FIG. 4 is a graph illustrating frequency responses of couple factor of an electric device composed of asymmetric planar inductors for different scales of overlap region.

FIG. 4 is a graph illustrating frequency responses of coupling factors of an electric device composed of asymmetric planar inductors for different scales of an overlap region. A curve C1 represents frequency responses of coupling factors of an electric device (a transform) composed of an asymmetric planar inductor (8-shaped planar inductor with coil numbers 2:1) and another asymmetric planar inductor (8-shaped planar inductor with coil numbers 2:1) stacked on the former asymmetric planar inductor, wherein the overlap region is maximized. A curve C2 represents a frequency response of coupling factor of an electric device (a transform) composed of an asymmetric planar inductor (8-shaped planar inductor with coil numbers 2:1) and a mirrored asymmetric planar inductor (8-shaped planar inductor with coil numbers 1:2) stacked on the former asymmetric planar inductor, wherein the overlap region is maximized to be nearly 100% overlapped. With respect to C1 and C2 in FIG. 4, at a low frequency (below 13 GHz), stacking the mirrored asymmetric planar inductor on the asymmetric planar inductor, or vice versa, can substantially reduce the coupling factor. Hence, when the desired coupling factor is low, the arrangement of C2 can achieve the same objective while occupying less area. Curves C3 and C5 can be obtained by changing the scale of the overlap region of the arrangement of C1 to 75% and 50%, respectively. Curves C4 and C6 can be obtained by changing the scale of the overlap region of the arrangement of C2 to 75% and 50%, respectively. With respect to C3, C4, C5 and C6 in FIG. 4, at a low frequency (below 10 GHz), stacking the mirrored asymmetric planar inductor on the asymmetric planar inductor, or vice versa, to a 75% and 50% overlap scale can substantially reduce the coupling factor. Hence, when the desired coupling factor is low, the arrangement can achieve the same objective while occupying less area.

Figure 5:
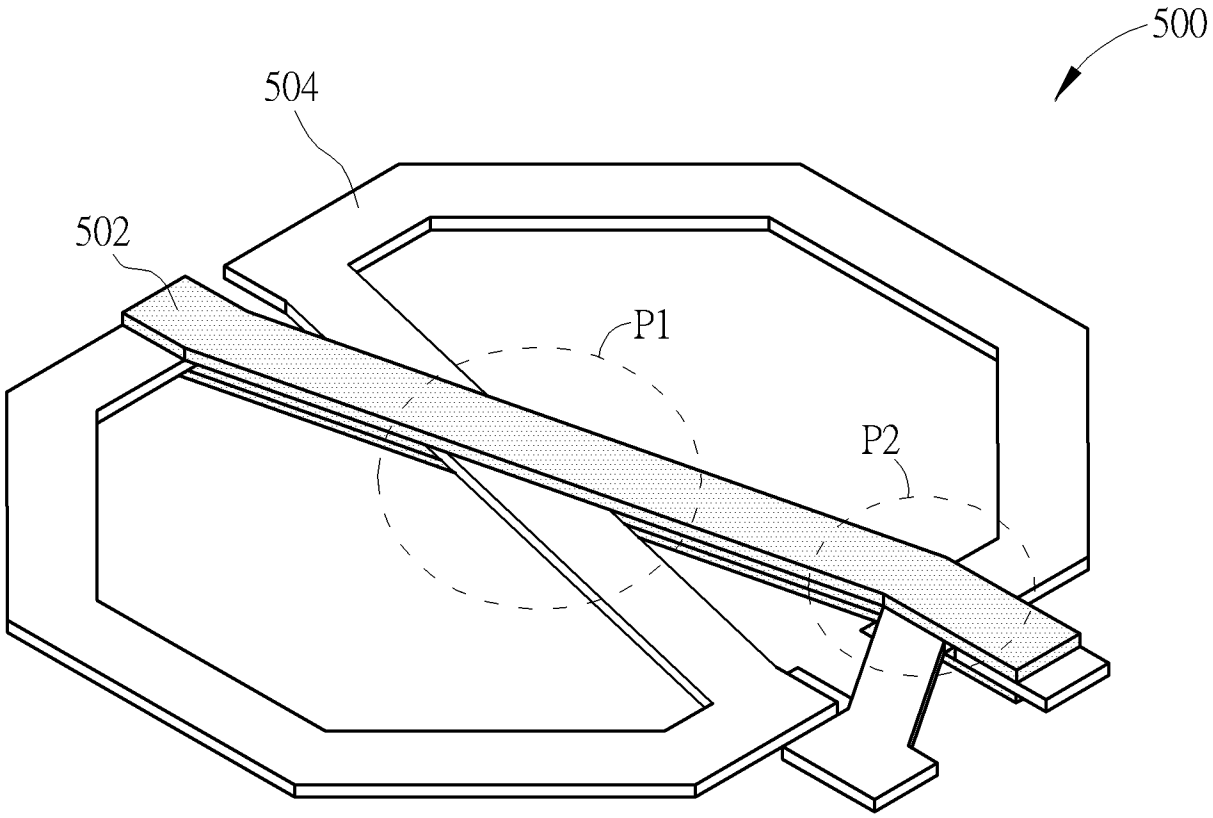
FIG. 5 is a diagram illustrating an electronic device according to an eighth embodiment of the present invention.
Figure 6:
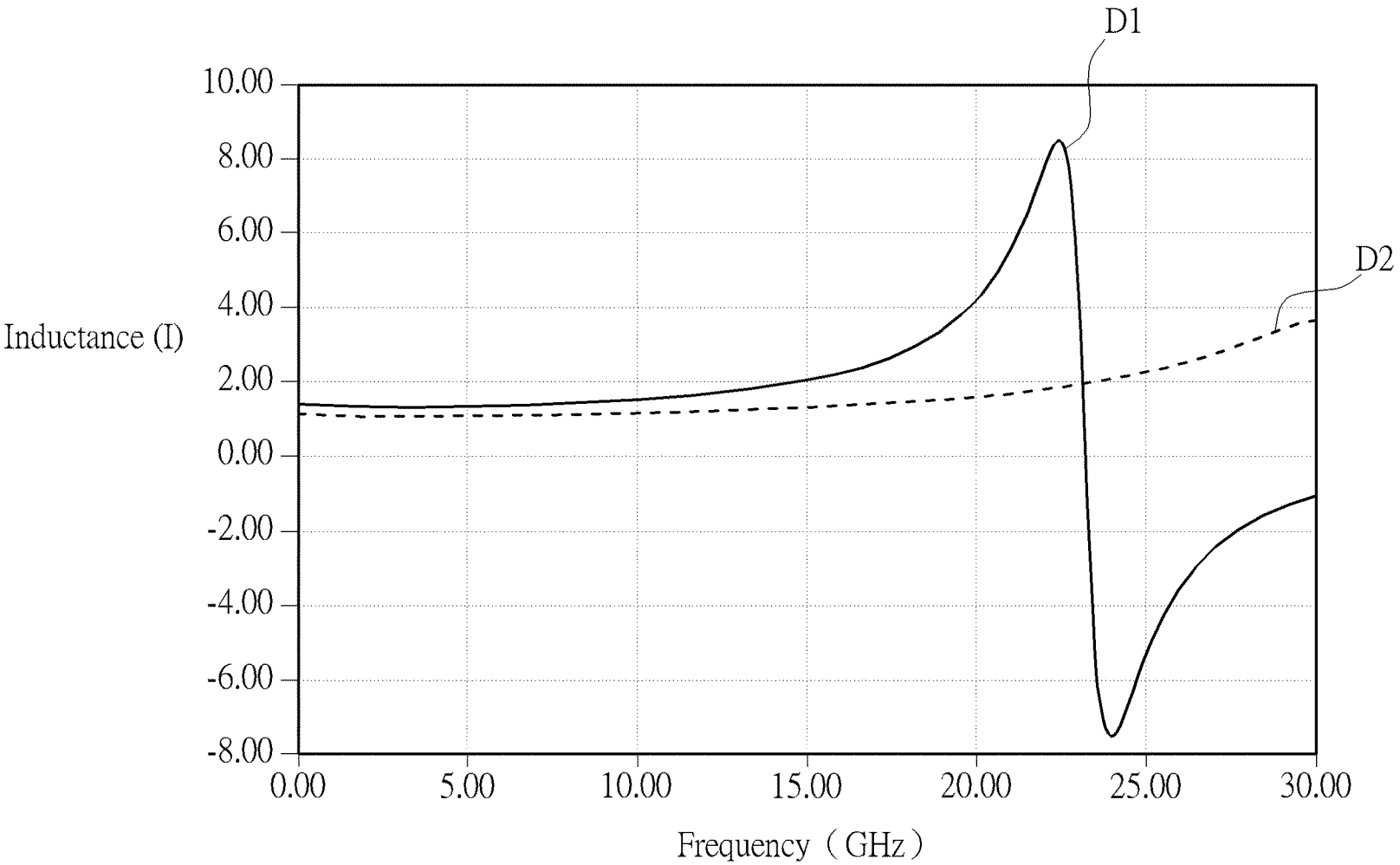
FIG. 6 is a graph illustrating frequency responses of inductance value of a non-8-shaped planar inductor and an 8-shaped planar inductor.

FIG. 5 is a diagram illustrating an electronic device according to an eighth embodiment of the present invention. The electronic device 500 is an 8-shaped planar inductor including a component 502 disposed at a first conducting layer 502 and another component 504 disposed at a second conducting layer 504. A first cross point P1 and a second cross point P2are two overlap regions between the component 502 and the component 504. FIG. 6 is a graph illustrating frequency responses of inductance values of a non-8-shaped planar inductor and an 8-shaped planar inductor. A curve D1 represents inductance values of the 8-shaped planar inductor of FIG. 5 for different frequencies; a curve D2 represents inductance values of the non-8-shaped planar inductor for different frequencies. The two planar inductors have the same area. In summary, the electric device 500 provides larger unit inductance in a certain frequency range, thus saving on die size and relevant hardware costs.

Note that the specific geometrics of the ring structure of the invention are not limited to the aforementioned embodiments. In another example, the ring structure of the planar inductor may be rectangular, circular or polygonal. Further, the arrangement of the ring structure and the wire routing are also not limited to the aforementioned embodiments.

In particular, it is envisaged that the aforementioned inventive concept can be applied by a semiconductor manufacturer to any integrated circuit. It is further envisaged that, for example, a semiconductor manufacturer may employ the inventive concept in the design of a stand-alone device, or application-specific integrated circuit (ASIC) and/or any other sub-system element.

Aspects of the invention may be implemented in any suitable form including hardware, software, firmware or any combination of these. The invention may be implemented, at least partly, as computer software running on one or more data processors and/or digital signal processors or configurable module components such as FPGA devices. Thus, the elements and components of an embodiment of the invention may be physically, functionally and logically implemented in any suitable way. The functionality may be implemented in a single unit, in a plurality of units or as part of other functional units.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term 'comprising' does not exclude the presence of other elements or steps.

Furthermore, although individually listed, a plurality of means, elements or method steps may be implemented by, for example, a single unit or processor or controller. Additionally, although individual features may be included in different claims, these may possibly be advantageously combined, and the inclusion in different claims does not imply that a combination of features is not feasible and/or advantageous. Also, the inclusion of a feature in one category of claims does not imply a limitation to this category, but rather indicates that the feature is equally applicable to other claim categories, as appropriate.

Furthermore, the order of features in the claims does not imply any specific order in which the features must be performed and in particular the order of individual steps in a method claim does not imply that the steps must be performed in this order. Rather, the steps may be performed in any suitable order. In addition, singular references do not exclude a plurality. Thus, references to 'a', 'an', 'first', 'second', etc. do not preclude a plurality.

Thus, an improved electronic device has been described, wherein the aforementioned disadvantages of prior art arrangements have been substantially alleviated.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electronic device, comprising:

a first planar inductor, comprising at least a first ring structure and a second ring structure physically connected in series for generating a first magnetic field having a first direction and a second magnetic field having a second direction respectively, wherein the first direction is different from the second direction; and a second planar inductor, comprising at least a third ring structure and a fourth ring structure physically connected in series for generating a third magnetic field having a third direction and a fourth magnetic field having a fourth direction respectively, wherein the third direction is different from the fourth direction;

wherein the first ring structure at least partially overlaps the third ring structure to form a first overlap region, and the second ring structure at least partially overlaps the fourth ring structure to form a second overlap region;

wherein the first planar inductor and the second planar inductor are electrically coupled by a via.

2. The electronic device of claim 1, wherein the first planar inductor has a first inductance value, the second planar inductor has a second inductance value, the first planar inductor is coupled to the second planar inductor to form a third inductor having a third inductance value greater than the first inductance value and the second inductance value, and the third inductance value is related to a scale of the first overlap region and a scale of the second overlap region.

3. The electronic device of claim 1, wherein the first direction is opposite to the third direction.

4. The electronic device of claim 1, wherein the first planar inductor is disposed at a first conducting layer and the second planar inductor is disposed at a second conducting layer.

5. The electronic device of claim 1, wherein the first ring structure and the second ring structure are disposed at a first conducting layer and a second conducting layer respectively, and the third ring structure and the fourth ring structure are disposed at the second conducting layer and the first conducting layer respectively.

6. The electronic device of claim 1, wherein the first planar inductor and the second planar inductor form a transformer.

7. The electronic device of claim 6, wherein the transformer comprises a coupling factor, which is related to a scale of the first overlap region and a scale of the second overlap region.

8. The electronic device of claim 1, wherein the first ring structure at least partially overlaps the fourth ring structure to form a third overlap region.

9. The electronic device of claim 8, wherein the first magnetic field is greater than the second magnetic field and the fourth magnetic field is greater than the third magnetic field.

10. The electronic device of claim 1, wherein openings of the first ring structure and the third ring structure are located at the same sides of the first ring structure and the third ring structure, and openings of the second ring structure and the fourth ring structure are located at different sides of the second ring structure and the fourth ring structure.

* * * * *